US012766370B2

(12) United States Patent
Balaban et al.

(10) Patent No.: US 12,766,370 B2
(45) Date of Patent: Oct. 20, 2026

(54) PUTTER HEAD AND STRIKE FACE INSERT THEREFOR

(71) Applicant: Blacksmith Golf Company Inc., London (CA)

(72) Inventors: Matthew Balaban, London (CA); Gareth Raflewski, London (CA); Marc Lefebvre, London (CA); Scott Cowx, London (CA); David Cowx, London (CA)

(73) Assignee: Blacksmith Putter Corporation, London (CA)

( * ) Notice: Subject to any disclaimer, the term of this patent is extended or adjusted under 35 U.S.C. 154(b) by 193 days.

(21) Appl. No.: 18/480,213

(22) Filed: Oct. 3, 2023

(65) Prior Publication Data

US 2024/0115911 A1 Apr. 11, 2024

Related U.S. Application Data

(60) Provisional application No. 63/413,410, filed on Oct. 5, 2022.

(51) Int. Cl.
*A63B 53/04* (2015.01)

(52) U.S. Cl.
CPC ..... *A63B 53/0416* (2020.08); *A63B 53/0441* (2020.08); *A63B 53/0487* (2013.01)

(58) Field of Classification Search
CPC ..... A63B 53/0416; A63B 53/0441; A63B 53/0487
See application file for complete search history.

(56) References Cited

U.S. PATENT DOCUMENTS

2005/0137027 A1* 6/2005 Thomas ..... A63B 53/0487 473/340
2007/0243950 A1* 10/2007 Billings ..... A63B 53/065 473/340

* cited by examiner

*Primary Examiner* — Raeann Gorden
(74) *Attorney, Agent, or Firm* — Dickinson Wright LLP; Matthew D. Powell

(57) ABSTRACT

A putter head for a golf putter is provided. The putter head comprises a body and insert. The body comprises a base; a face portion having a ball-facing surface with a non-zero first loft angle A; a window framed by the ball-facing surface and extending through the face portion; and an open-topped dock extending into the base rearwardly from the window. The insert is removably affixable to the body. The insert comprises: an insert body having a ball strike face with a second loft angle in the range of: 0 to A; and a foot extending rearwardly from the insert body. The foot is dimensioned to be inserted through the window and seated in the open-topped dock. The insert body is dimensioned to be received by and seated within the window.

30 Claims, 7 Drawing Sheets

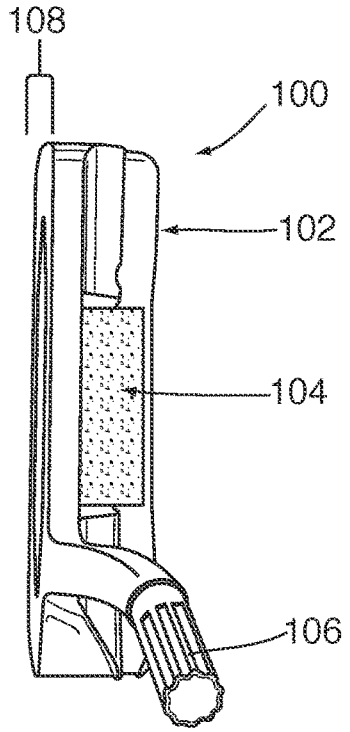
Fig. 1a
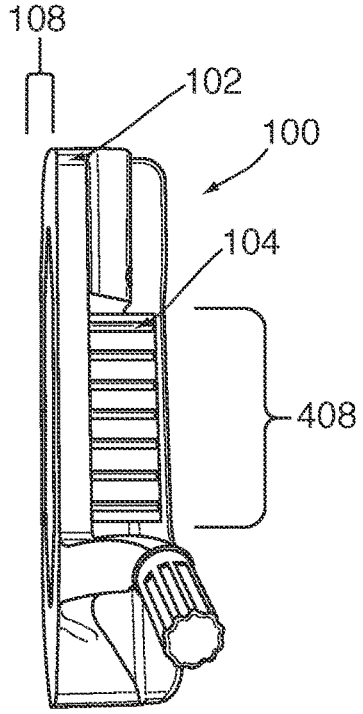
Fig. 1c
Fig. 1b
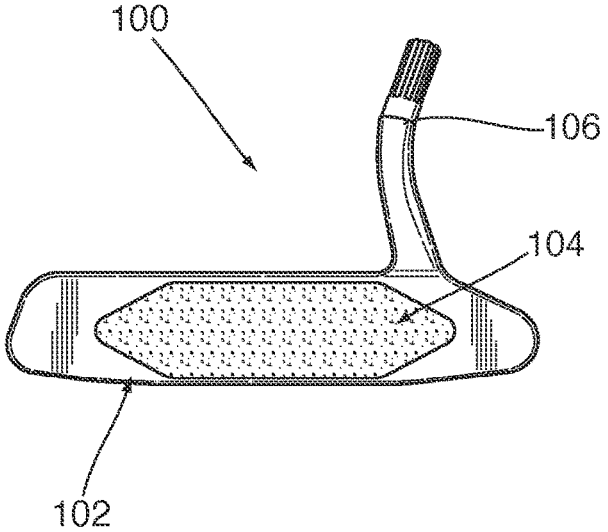
Fig. 1d
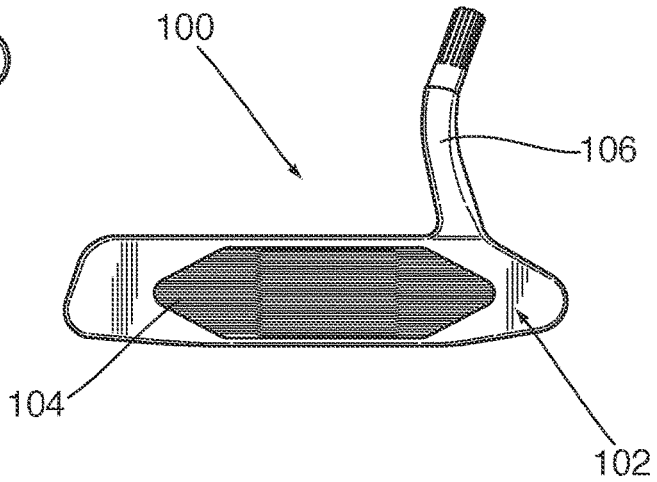

PUTTER HEAD AND STRIKE FACE INSERT THEREFOR

This application claims priority to U.S. Provisional Patent Application No. 63/413,410 filed on Oct. 5, 2022, titled "Golf Putters with Putter Heads Adapted to Receive Different Ball Striking Inserts and Ball Striking Inserts for Same". The present invention relates generally to golf putters and specifically to golf putter heads configured to receive different strike face inserts as well as the strike face inserts therefor.

BACKGROUND

In golf, a putter is the club typically used when a ball is on or near the green. Although the putter is often referred to as a flat stick, the putter is rarely completely flat and has some degree of loft. Typically, putters tend to have a loft between two and four degrees. The loft is necessary because the ball sits or rests slightly down in the grass and is not level with the surface. Accordingly, the loft will help lift the ball and get it rolling smoothly to the hole. However, the best loft for the putter may vary with the type of grass used for the green and a golfer's putting stroke. Accordingly, even once the golfer identifies the best loft for their putting stroke, the effectiveness of the loft may vary on different golf courses with different grass.

It is therefore an object of the present invention to provide a novel putter that obviates or mitigates the above mentioned disadvantages.

SUMMARY

In accordance with an aspect of an embodiment a putter head for a golf putter comprises a body and insert. The body comprises: a base; a face portion having a ball-facing surface with a non-zero first loft angle A; a window framed by the ball-facing surface and extending through the face portion; and an open-topped dock extending into the base rearwardly from the window. The insert is removably affixable to the body. The insert comprises: an insert body having a ball strike face with a second loft angle in the range of: 0 to A; and a foot extending rearwardly from the insert body. The foot is dimensioned to be inserted through the window and seated in the open-topped dock. The insert body is dimensioned to be received by and seated within the window.

In an embodiment, the insert may comprise an alignment guide along a top surface of the foot, wherein when the foot is seated in the open-topped dock the alignment guide is visible. The alignment guide may comprise at least one embossed and/or debossed line.

In an embodiment, the second loft angle of the ball strike face may be less than or equal to A. The ball strike face of the insert body may comprise a plurality of grooves. The ball strike face of the insert body may be continuously smooth. In an embodiment, the insert body and foot may be integrally formed from a single piece of material. The material may be selected from the group consisting of: copper and steel.

In an embodiment, the body further comprises stop structure dimensioned to bear against a rearward-facing side of the insert body when the insert body is seated within the window. At least one removable fastener may fasten the stop structure to the rearward-facing side of the insert body. The at least one removable fastener may be a threaded fastener. The stop structure may comprise at least one recess in the ball-facing surface adjacent to the window. The at least one recess may comprise a first recess on a toe side of the window and a second recess on a heel side of the window. In an embodiment, the putter head may further comprise a first bore through the first recess; a second bore through the second recess; third and fourth threaded bores extending only partway into the insert body from the rearward-facing side; and removable threaded fasteners passable through respective ones of the first and second bores and threadable into respective ones of the third and fourth threaded bores thereby to removably affix the insert to the putter head. The first and second bores may each be threaded to facilitate threading of the respective removable threaded fasteners into the first and second bores.

In an embodiment, a golf putter comprises a shaft coupled to the putter head described above. The shaft may be coupled to the putter head via a hosel.

In accordance with another aspect of an embodiment, there is provided a removably affixable insert for a putter head. The insert comprises: an insert body having a ball strike face with a second loft angle, the second loft angle in the range of 0 to a first loft angle A of the putter head; and a foot extending rearwardly from the insert body. The foot is dimensioned to be inserted through a window of the putter head and to be seated in an open-topped dock therein. The insert body is dimensioned to be received by and seated within the window.

In an embodiment, the insert body and the foot may be integrally formed from a single piece of material. The ball strike face may comprise a plurality of grooves. The insert body may further comprise wings extending on either side thereof. Each of the wings may comprise a threaded bore extending only partway into the insert body from the rearward-facing side.

In accordance with another aspect of an embodiment, there is provided putter kit comprising a putter as set forth above; and an alternative insert receivable within the putter head in lieu of the insert, wherein the alternative insert is different from the insert in at least one of the qualities of: second loft angle, material, weight, a presence or absence of embossed and/or debossed markings on the ball strike face, a format of embossed and/or debossed markings on the ball strike face, a presence or absence of an alignment guide along a top surface of the foot, and a format of an alignment guide along the top surface of the foot.

BRIEF DESCRIPTION OF THE DRAWINGS

Embodiments will now be described by way of example only with reference to the accompanying drawings in which:

FIG. 1*a* is a top view of a putter head;

FIG. 1*b* is a front view of the putter head of FIG. 1*a;*

FIG. 1*c* is a top view of a putter head having a different insert than the putter head of FIG. 1*a;*

FIG. 1*d* is a front view of the putter head of FIG. 1*c;*

DETAILED DESCRIPTION OF THE EMBODIMENTS

Figure 2A:
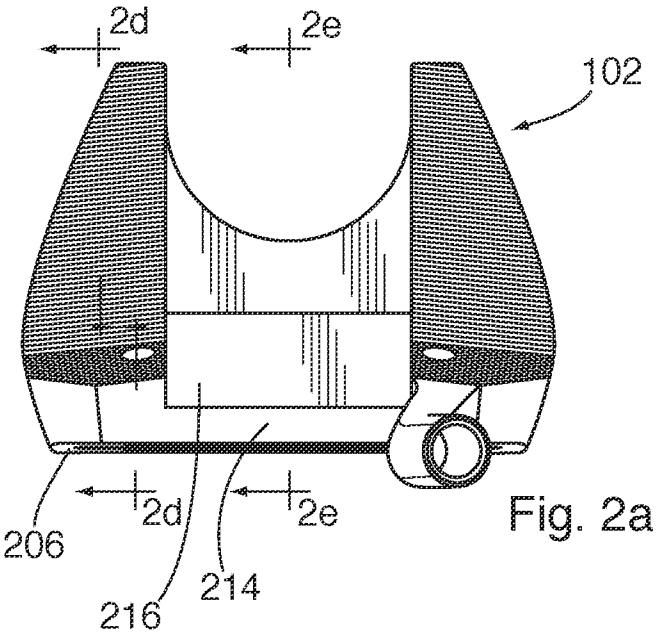
FIG. 2*a* is a top view of a mallet-style putter head body.
Figure 2B:
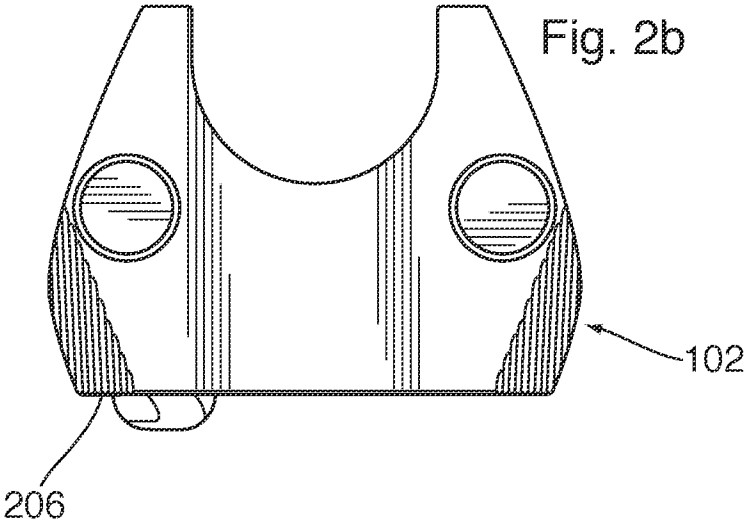
FIG. 2*b* is a bottom view of the putter head body of FIG. 2*a;*
Figure 2D:
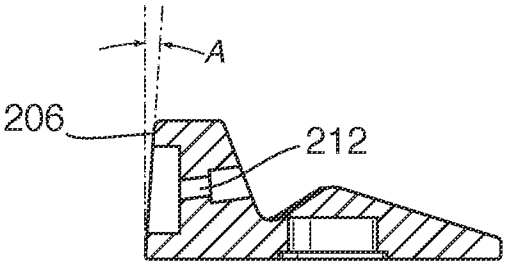
FIG. 2*d* is a cross-sectional view taken along line A-A in FIG. 2*a;*
Figure 2E:
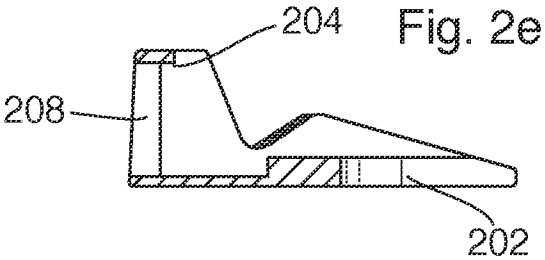
FIG. 2*e* is a cross-sectional view taken along line B-B in FIG. 2*a;*
Figure 2C:
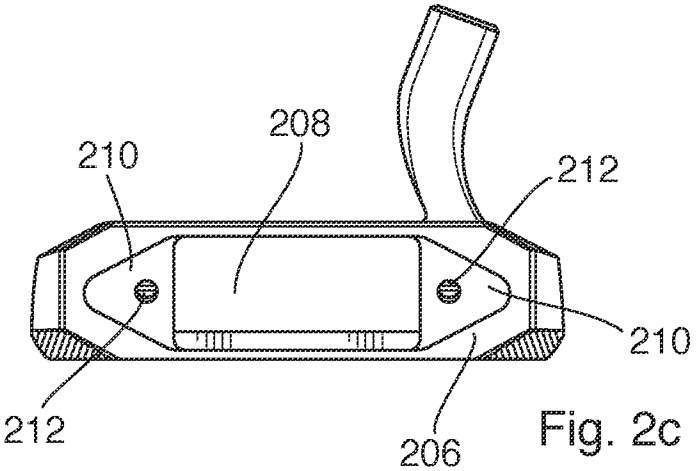
FIG. 2*c* is a front view of the putter head body of FIG. 2*a;*
Figure 3B:
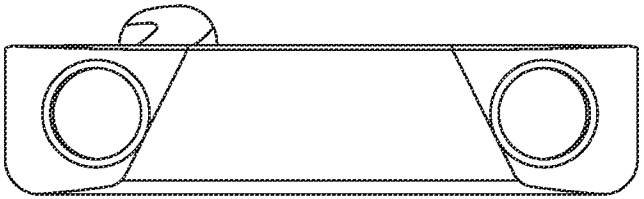
FIG. 3*b* is a bottom view of the putter head body of FIG. 3*a;*
Figure 3E:
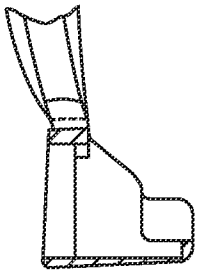
FIG. 3*e* is a cross-sectional view taken along line B-B in FIG. 3*a;*
Figure 3D:
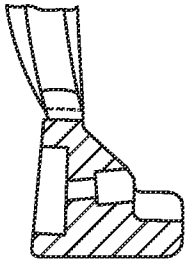
FIG. 3*d* is a cross-sectional view taken along line A-A in FIG. 3*a;*
Figure 3A:
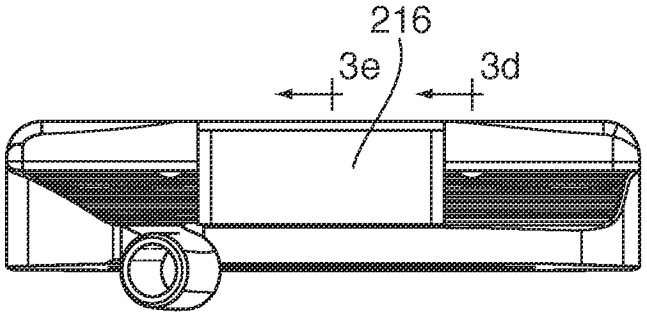
FIG. 3*a* is a top view of a blade-style putter head body.
Figure 3C:
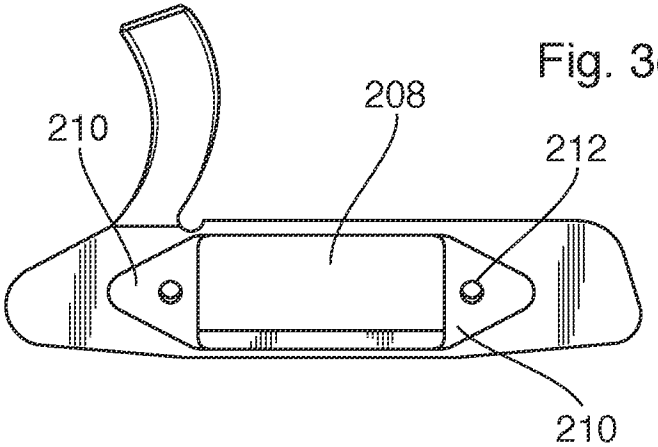
FIG. 3*c* is a front view of the putter head body of FIG. 3*a;*

For convenience, like numerals in the description refer to like structures in the drawings. Referring to FIGS. 1*a* to 1*d*, a putter head in accordance with an embodiment is illustrated generally by numeral 100. The putter head 100 includes a body 102 and a strike face insert (or insert) 104. In an embodiment, the putter head 100 may also include a hosel 106 attached to the body 102. The hosel 106 is configured to couple the putter head 100 to a putter shaft (illustrated in FIG. 7).

Referring to FIGS. 2*a* to 2*e*, the body 102 is illustrated without the insert 104. In the embodiment shown, the body 102 is shaped for a mallet-style putter head 100. The body 102 includes a base 202 and a face portion 204. The face portion 204 includes a ball-facing surface 206, a window 208, a stop structure 210, bores 212, a topline 214. The base 202 comprises an open-topped dock 216. The ball-facing surface 206 has a first loft angle A. The first loft angle A is the maximum loft for the putter head 100.

The window 208 is framed by the ball-facing surface 206 and extends through the face portion 204. The stop structure 210 is dimensioned to bear against a rearward-facing side of the insert 104 when the insert 104 is seated within the window 208. In an embodiment, the stop structure 210 comprises at least one recess in the ball-facing surface 206 adjacent to the window 208. In an embodiment, the stop structure 210 comprises a first recess in the ball-facing surface 206 on a toe side of the window 208 and a second recess in the ball-facing surface 206 on a heel side of the window 208. Each of the bores 212 extends through the face portion 204 within a corresponding one of the first and second recesses 210. In an embodiment, the bores 212 may be threaded. The open-topped dock 216 extends into the base 202 rearwardly from the rear side of the window 208.

Referring to FIGS. 3*a* to 3*e*, another embodiment of the body is illustrated by 102. In the illustrated embodiment, the body 102 is shaped for a blade-style putter head 100. Although not illustrated, the body 102 may also be shaped for a mid-mallet-style putter head 100. Although the bodies 102 may be shaped differently, the respective windows 208 and open-topped docks 216 are sized the same so that each body 102 can receive any of the inserts 104.

Referring to FIGS. 4*a* to 4*d*, the insert 104 is illustrated in isolation. The insert 104 includes an insert body 402 and a foot 404. The insert body 402 and the foot 404 form a single-piece insert 104. In an embodiment, the insert body 402 and the foot 404 are integrally formed from a single piece of material. The insert body 402 has a forward facing ball strike face 406. The foot 404 extends rearwardly from the insert body 402. The foot 404 is sized and shaped (i.e. dimensioned) to be inserted through the window 208 of the body 102 and seated in the open-topped dock 216.

In an embodiment, the foot 404 may further comprise an alignment guide 408 (illustrated in FIG. 1*c*). In an embodiment, the alignment guide 408 is positioned along a top surface of the foot 404. Thus, when the foot 404 is seated in the open-topped dock 216 the alignment guide is visible. The alignment guide 408 may comprise at least one embossed, debossed, or otherwise marked line. For example, the alignment guide 408 may comprise a painted or otherwise visually distinguishable mark on a smooth surface, rather than etched, embossed or debossed surface. As another example, the alignment guide may be both etched, embossed or debossed and marked.

Different inserts 104 may have different, or no, alignment guides 408, but be otherwise qualitatively the same as another insert 104. For example, referring for FIG. 1*c*, the alignment guide 408 comprises a multi-line debossed alignment guide 408 extending along the top surface of the foot 404. In contrast, the foot 404 illustrated in FIG. 1*a* does not include an alignment guide 408.

The insert body 402 includes wings 410 extending on either side thereof. The wings 410 are sized and shaped to be received by stop structure 210 of the putter head body 102. Thus, the wings 410 prevent the insert body 402 from being passed through the window 208 of the putter head body 102 when the foot is 404 is seated within the open-topped dock 216. Coupling bores 412 are formed in each of the wings 410. The coupling bores 412 are formed in a rearward facing surface 414 of the insert body 402. The coupling bores 412 extend into, but not through, the insert body 402. The coupling bores 412 are threaded to receive removable fasteners. The removable fasteners are passed, or threaded, through the bores 212 in the putter head body 102 and into the bores 412 of the insert body 402 to thereby affix the insert 104 to the putter head body 102.

The insert 104 may be formed of any suitable material including, for example, copper and steel. It will be appreciated that different inserts 104 may have different materials. The inserts 104 may be exactly the same in all respects, except for a difference in material.

Figure 4B:
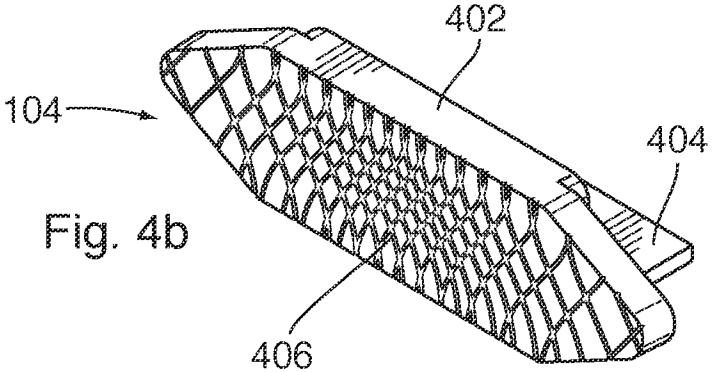
FIG. 4*b* is a top-front isometric view of the putter insert of FIG. 4*a;*
Figure 4D:
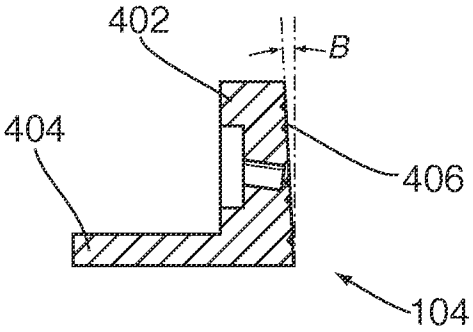
FIG. 4*d* is a cross-sectional view taken along line A-A in FIG. 4*c;*
Figure 4A:
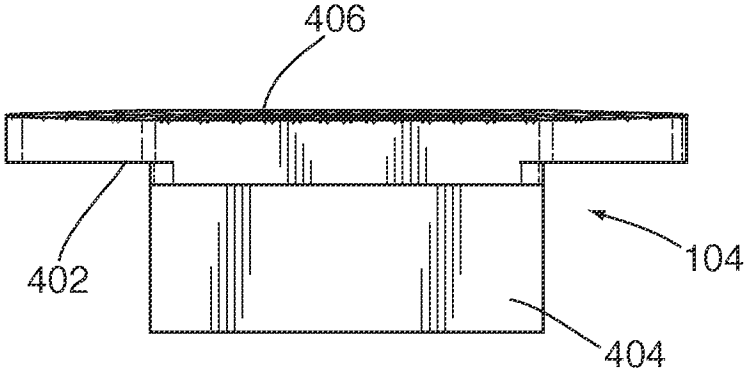
FIG. 4*a* is a top view of an insert for the putter insert.
Figure 4C:
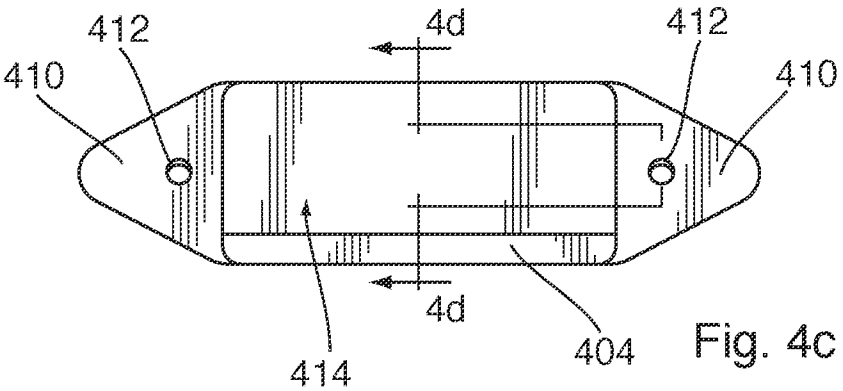
FIG. 4*c* is a front view of the putter insert of FIG. 4*a;*

The ball strike face 406 can be a flat, smoothed brush surface, as illustrated for example in FIG. 1*b*. Alternatively, the ball strike face 406 can have a grooved surface. The grooved surface can form a plurality of different patterns. For example, the grooved surface can provide a plurality of linear, parallel grooves, as illustrated in FIG. 1*d*. As another example, the grooved surface can provide patterned grooves, as illustrated in FIG. 4*b*. The grooves can be cut into or otherwise debossed into the ball strike face 406. It will be appreciated that different insert bodies 402 may have different ball strike faces 406. The insert bodies 402 may be exactly the same in all respects, except for a difference in the ball strike faces 406.

The ball strike face 406 has a second loft angle B. The second loft angle B is in the range of 0 to the first loft angle A. For example, the putter head body 102 may have a first loft angle A of 4 degrees. The ball strike face 406 may have a second loft angle B of 4 degrees. It will be appreciated that different insert bodies 402 may have different second loft angles B. The inserts 104 may be exactly the same in all respects, except for a difference in the second loft angle B. As an example, such inserts 104 may have loft angles of 3 degrees, 2 degrees, 1 degree, or 0 degree, or some other angle in between (in this example embodiment) 0 and 4 degrees.

As will be appreciated, a putter head body 102 is adapted to receive one of a plurality of corresponding interchangeable inserts 104. Different inserts 104 can be provided comprising various combination of materials, second loft angles B, and ball strike face 406 surface configurations. The golfer may therefore have a set of chosen inserts 104 usable for different conditions, while overall being able to wield the golf club to address the ball in the same manner across all inserts.

When viewed from above, due to the non-zero first loft angle A, a generally-rectangular "shadow" region 108 (illustrated in FIGS. 1*a* and 1*c*) becomes apparent between the front top edge of the topline 214 of the body 102 and the front bottom edge of the ball-facing surface 206 of the body 102. The insert 104, has a second loft angle B that is between 0 degrees and the first loft angle A. As a result, even though the insert 104 may have a different loft angle to the body 102, the ball strike face 406 of the insert 104 will stay within the shadow region 108. In particular, in some embodiments the second loft angle B may be the same as the first loft angle A, which would cause the ball strike face 406 of the insert to be flush with the ball-facing surface 206 of the body 102. In other embodiments, the second loft angle B may differ from the first loft angle A, which would cause the ball strike face 406 of the insert to protrude from the ball-facing surface 206 of the body 102. However, the difference between the first loft angle A and the second loft angle B, if one exists, does not manifest visually as greatly different or distracting to the golfer when viewing the putter head 100 from above. As such, the golfer can realize different loft angles using different inserts 104, without having a corresponding changed visual perspective between the topline 214 of the putter head 100 and the ball at the time of addressing the ball. In this way, the golfer can use different inserts 104 in the putter head 100 without having to change how the ball is addressed and with minimal corresponding visual distraction.

The golfer may choose an insert 104 based on insert characteristics including, for example, a loft angle, material, weight, presence or absence of grooves or markings on the ball strike face 406, a format, shape, or pattern of the grooves or markings on the ball strike face 406, a presence or absence of an alignment guide 408, a format of the alignment guide 408, and the like. Other inserts 104 with differing combinations of the insert characteristics may also be provided. Each insert may be provided with other visual differences that are apparent to the golfer when the putter head is viewed from above, rearward from the topline 214. In an embodiment, when viewed from above during use by the golfer, the topline 214 of the putter head and forward towards the ball from the topline 214 look substantially the same, regardless as to which insert 104 is inserted. In this way, the golfer is provided with a minimally changed visual perspective on the interaction between the ball strike face 406 and the ball.

Visual differences in respect of the ball strike face 406 and second loft angle B of the insert 104 may be apparent when the putter is viewed from other perspectives. Further, other visual differences in respect of different inserts may visible when viewed from above. For example, the foot 404 of the insert 104 may have a different or no alignment guide viewable from above, a different colour, a different material, and/or other differences.

The configurations disclosed herein enable the golfer to maintain a familiar orientation of the ball-facing surface 206 and the topline 214 of the putter with respect to the ball due to the common visual perspective achieved with all suitable inserts 104. At the same time, different inserts 104 can be used to provide different qualitative interactions with the ball including, for example, different loft angles B, different ball strike face 406 interactions with the ball, strike feel, strike sound, amount of post-strike vibration, alignment guides 408, and the like. This enables the golfer to maintain consistency of swing and ball interaction, thereby enabling the golfer to address the ball predictably while potentially achieving different ball strike outcomes due to the qualitatively different inserts 104.

Figure 5:
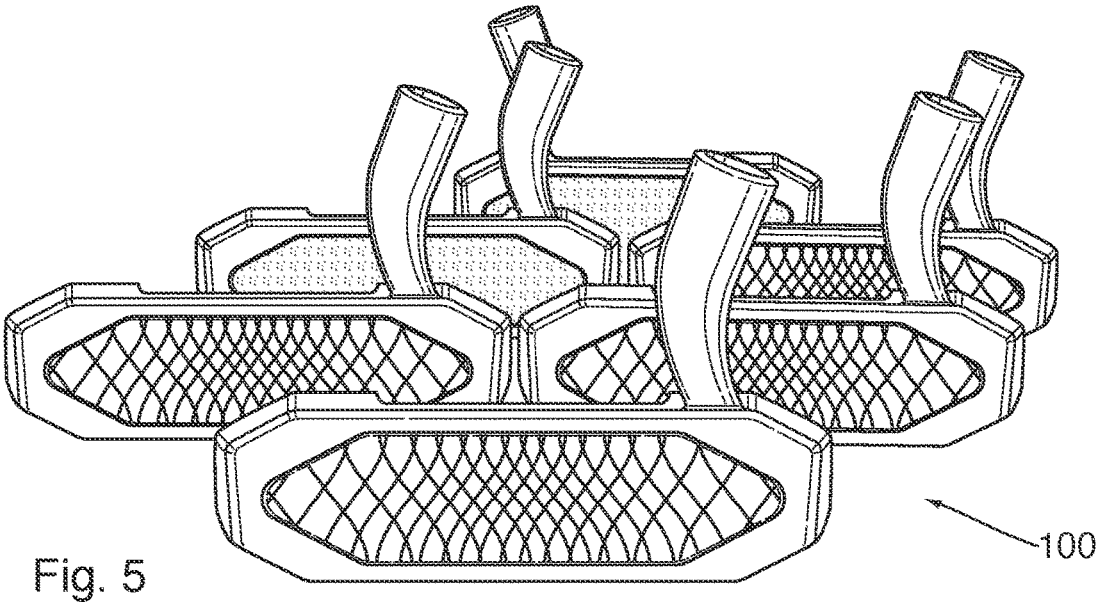
FIG. 5 illustrates a plurality of putter heads.

Referring to FIG. 5, a plurality of putter heads 100 are illustrated. Each of the putter heads 100 has a body 102 with a respective insert 104 connected thereto. Each of the inserts 104 has different respective materials and ball strike face grooves/configurations.

Figure 6:
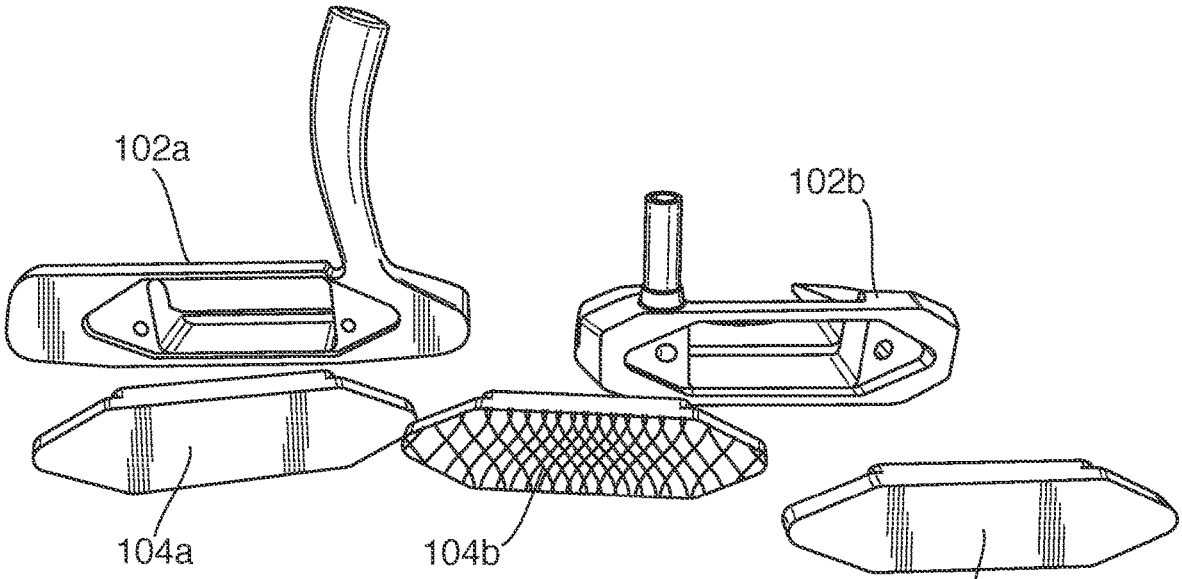
FIG. 6 illustrates a plurality of putter head bodies and inserts.

Referring to FIG. 6, different putter head bodies 102*a* and 102*b* and different inserts 104*a*, 104*b*, and 104*c* are shown. One putter head body 102*a* is a right-handed blade-style putter body. The other putter head body 102*b* is a left-handed mullet-style body. One insert 104*a* comprises copper, has a smooth ball strike face, and has no alignment guide 408. Another insert 104*b* comprises copper, has a grooved ball strike face 406, and has an alignment guide 408. The other insert 104*c* comprises steel, has a smooth ball strike face 406, and has an alignment guide 408. Although the bodies 102 and the inserts 104 are themselves different from each other, each of the bodies 102 can receive any of the inserts 104.

Figure 7:
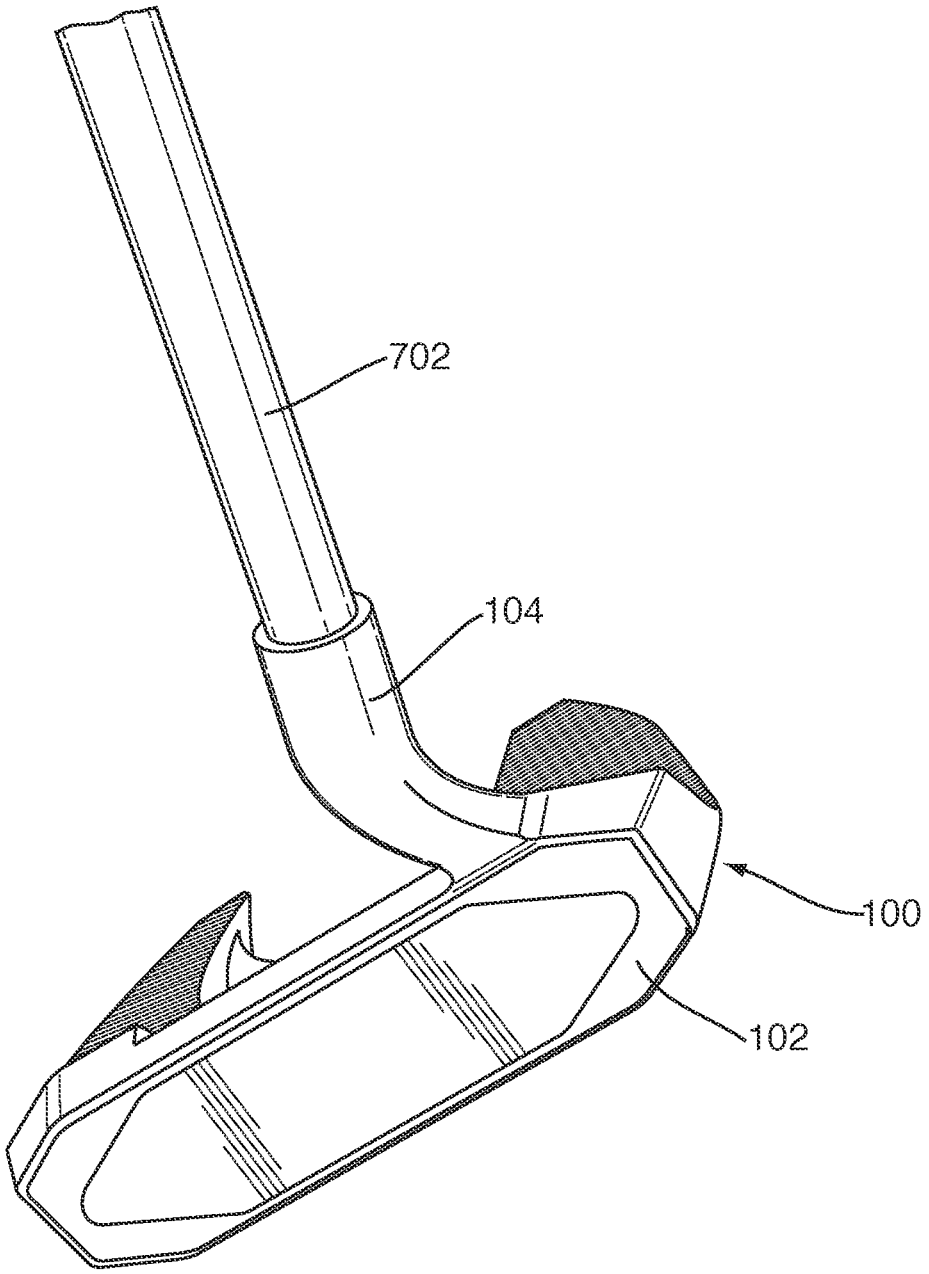
FIG. 7 is a front isometric view of the putter head coupled to a shaft.
Figure 8:
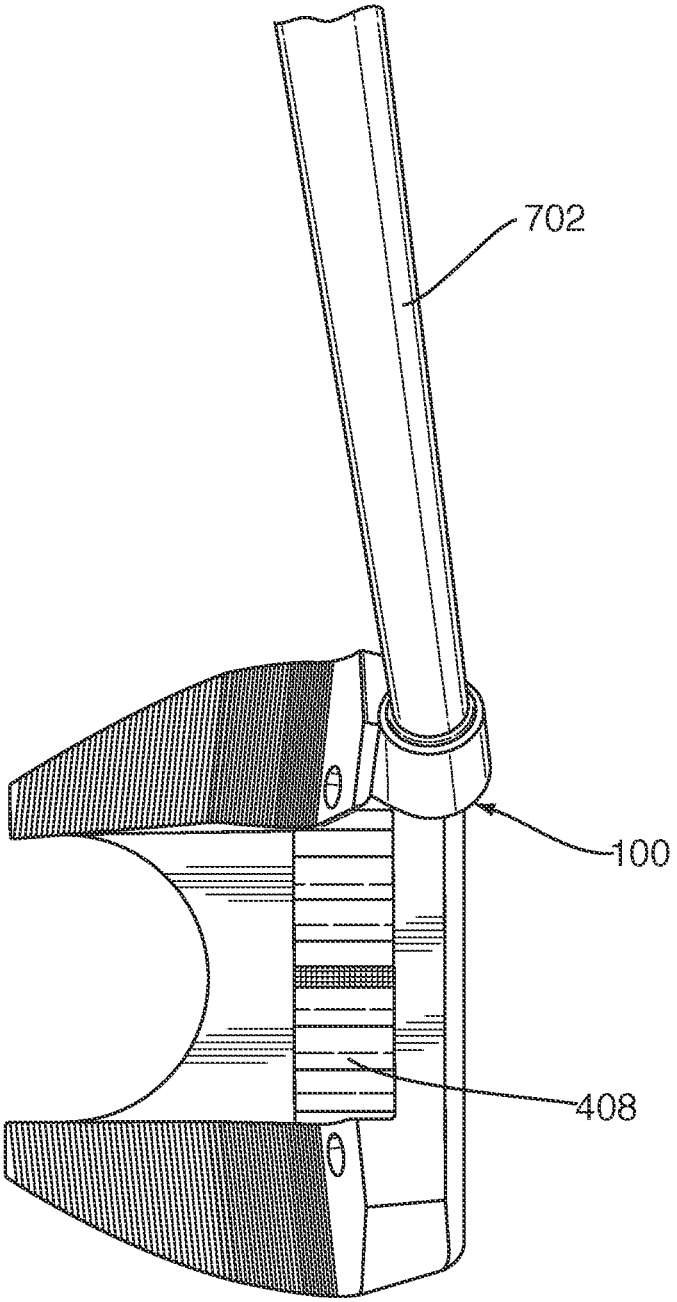
FIG. 8 is a top view of the putter head coupled to the shaft.

Referring to FIG. 7, a front isometric view of the putter head 100 coupled to a shaft 702 to form a golf club is shown. In the embodiment illustrated, the hosel 106 is a slant neck hosel. As will be appreciated, any type of hosel can be used include, for example, the slant neck hosel, a plumber neck hosel, a flow neck hosel, and the like. Alternatively, the shaft 702 may be coupled directly to the putter head 100. In such embodiments, the shaft may comprise a double bend neck, a single bend neck, a centre shaft, and the like. Referring to FIG. 8, a top view of the golf club of FIG. 11 is shown. As illustrated, in this embodiment the insert 104 includes the alignment guide 408.

While embodiments have been described, alternatives are possible. For example, in an alternative embodiment, more or less than two fasteners may be used to affix the insert 104 to the body 102. Such a fastener or fasteners may be threaded fasteners. Other means for affixing the insert 104 to the body may be provided, such as a reliable latch or other mechanism.

A golfer may have a kit that includes several different inserts and a single golf club with putter head, so that the golfer can interchange inserts as desired for particular qualitative interactions with the ball (as in loft angle, sound, solidity, vibration, etc.) as well as for different styles of alignment guide, or no alignment guide, different aesthetic appearances, and the like.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any sub-combination. Further, references to values stated in ranges include each and every value within that range.

What is claimed is:

1. A putter head for a golf putter, the putter head comprising:

a body comprising:

a base;

a face portion having a ball-facing surface with a non-zero first loft angle A;

a window framed by the ball-facing surface and extending through the face portion; and an open-topped dock extending into the base rearwardly from the window; and an insert removably affixable to the body, the insert comprising:

an insert body having a ball strike face with a second loft angle in the range of: 0 to A; and a foot extending rearwardly from the insert body, wherein:

the foot is dimensioned to be inserted through the window and seated in the open-topped dock; and the insert body is dimensioned to be received by and seated within the window, wherein the insert body and foot are integrally formed from a single piece of material, wherein the material is selected from the group consisting of copper and steel.

2. The putter head of claim 1, wherein the insert comprises:

an alignment guide along a top surface of the foot, wherein when the foot is seated in the open-topped dock the alignment guide is visible.

3. The putter head of claim 2, wherein the alignment guide comprises at least one embossed and/or debossed line.

4. The putter head of claim 1, wherein the second loft angle of the ball strike face is less than A.

5. The putter head of claim 1, wherein the ball strike face of the insert body comprises a plurality of grooves.

6. The putter head of claim 1, wherein the ball strike face of the insert body is continuously smooth.

7. The putter head of claim 1, wherein the body further comprises:

stop structure dimensioned to bear against a rearward-facing side of the insert body when the insert body is seated within the window.

8. The putter head of claim 7, further comprising:

at least one removable fastener for fastening the stop structure to the rearward-facing side of the insert body.

9. The putter head of claim 8, wherein the at least one removable fastener is a threaded fastener.

10. The putter head of claim 7, wherein the stop structure comprises at least one recess in the ball-facing surface adjacent to the window.

11. The putter head of claim 10, wherein the at least one recess comprises a first recess on a toe side of the window and a second recess on a heel side of the window.

12. The putter head of claim 11, further comprising:

a first bore through the first recess;

a second bore through the second recess;

third and fourth threaded bores extending only partway into the insert body from the rearward-facing side; and removable threaded fasteners passable through respective ones of the first and second bores and threadable into respective ones of the third and fourth threaded bores thereby to removably affix the insert to the putter head.

13. The putter head of claim 12, wherein the first and second bores are each threaded to facilitate threading of the respective removable threaded fasteners into the first and second bores.

14. A golf putter comprising a shaft coupled to the putter head of claim 1.

15. The golf putter of claim 14, wherein the shaft is coupled to the putter head via a hosel.

16. A putter head for a golf putter, the putter head comprising:

a body comprising:

a base;

a face portion having a ball-facing surface with a non-zero first loft angle A;

a window framed by the ball-facing surface and extending through the face portion; and an open-topped dock extending into the base rearwardly from the window; and an insert removably affixable to the body, the insert comprising:

an insert body having a ball strike face with a second loft angle in the range of: 0 to A; and a foot extending rearwardly from the insert body, wherein:

the foot is dimensioned to be inserted through the window and seated in the open-topped dock; and the insert body is dimensioned to be received by and seated within the window, wherein the body further comprises:

stop structure dimensioned to bear against a rearward-facing side of the insert body when the insert body is seated within the window, wherein the stop structure comprises at least one recess in the ball-facing surface adjacent to the window.

17. The putter head of claim 16, wherein the insert comprises:

an alignment guide along a top surface of the foot, wherein when the foot is seated in the open-topped dock the alignment guide is visible.

18. The putter head of claim 17, wherein the alignment guide comprises at least one embossed and/or debossed line.

19. The putter head of claim 16, wherein the second loft angle of the ball strike face is less than A.

20. The putter head of claim 16, wherein the insert body and foot are integrally formed from a single piece of material.

21. The putter head of claim 20, wherein the material is selected from the group consisting of: copper and steel.

22. The putter head of claim 16, wherein the ball strike face of the insert body comprises a plurality of grooves.

23. The putter head of claim 16, wherein the ball strike face of the insert body is continuously smooth.

24. The putter head of claim 16, further comprising:

at least one removable fastener for fastening the stop structure to the rearward-facing side of the insert body.

25. The putter head of claim 24, wherein the at least one removable fastener is a threaded fastener.

26. The putter head of claim 16, wherein the at least one recess comprises a first recess on a toe side of the window and a second recess on a heel side of the window.

27. The putter head of claim 26, further comprising:

a first bore through the first recess;

a second bore through the second recess;

third and fourth threaded bores extending only partway into the insert body from the rearward-facing side; and removable threaded fasteners passable through respective ones of the first and second bores and threadable into respective ones of the third and fourth threaded bores thereby to removably affix the insert to the putter head.

28. The putter head of claim 27, wherein the first and second bores are each threaded to facilitate threading of the respective removable threaded fasteners into the first and second bores.

29. A golf putter comprising a shaft coupled to the putter head of claim 16.

30. The golf putter of claim 29, wherein the shaft is coupled to the putter head via a hosel.

* * * * *